US005286613A

United States Patent [19]

Begley et al.

[11] Patent Number: 5,286,613

[45] Date of Patent: Feb. 15, 1994

[54] PHOTOGRAPHIC MATERIAL COMPRISING A COMBINATION OF COUPLERS FORMING WASHOUT AND NON-WASHOUT DYES

[75] Inventors: William J. Begley, Webster; Hans G. Ling, Rochester; Drake M. Michno, Webster, all of N.Y.

[73] Assignee: Eastman Kodak Company, Rochester, N.Y.

[21] Appl. No.: 903,794

[22] Filed: Jun. 24, 1992

[51] Int. Cl.[5] ..... G03C 7/32; G03C 7/34; G03C 7/36; G03C 7/38

[52] U.S. Cl. ..... 430/382; 430/544; 430/549; 430/957

[58] Field of Search ..... 430/544, 549, 957, 226, 430/382

[56] References Cited

U.S. PATENT DOCUMENTS

| | | | |
|---|---|---|---|
| 3,227,550 | 1/1966 | Whitmore et al. | 430/241 |
| 4,248,962 | 2/1981 | Lau | 430/382 |
| 4,409,323 | 10/1983 | Sato et al. | 430/544 |
| 4,482,629 | 11/1984 | Nakagawa et al. | 430/542 |
| 4,746,600 | 5/1988 | Watanabe et al. | 430/544 |
| 4,861,701 | 8/1989 | Burns et al. | 430/543 |
| 4,959,299 | 9/1990 | Sakanoue et al. | 430/549 |
| 5,026,628 | 5/1991 | Begley et al. | 430/382 |
| 5,151,343 | 9/1992 | Begley et al. | 430/382 |

FOREIGN PATENT DOCUMENTS

| | | |
|---|---|---|
| 0204175 | 12/1986 | European Pat. Off. . |
| 0522371 | 1/1993 | European Pat. Off. . |

*Primary Examiner*—Richard L. Schilling
*Attorney, Agent, or Firm*—Andrew Alexander

[57] ABSTRACT

A color photographic element comprising a support bearing at least one photographic silver halide emulsion layer and a combination of at least two couplers (A) and (B), coupler (A) capable upon reaction with oxidized developer of forming a compound that is washed out of the photographic element during photographic processing and capable of releasing a photographic development inhibitor or a timing group having a photographic development inhibitor, the timing group capable of providing timed release of said photographic development inhibitor and coupler (B) capable upon reaction with oxidized developer of forming a compound that is not washed out of the photographic element during photographic processing and capable of releasing a photographic development inhibitor with or without time delay. Such a color photographic material enables formation of improved color images.

21 Claims, No Drawings

PHOTOGRAPHIC MATERIAL COMPRISING A COMBINATION OF COUPLERS FORMING WASHOUT AND NON-WASHOUT DYES

This invention relates to a photographic material and processing comprising a combination of couplers at least one of which is a coupler capable of forming a wash-out dye in a photographic material upon photographic processing to form an improved image.

Various ways are recognized in the photographic art for release of a photographic development inhibitor group (INH) from a compound, such as a coupler, in a photographic material and process. For example, U.S. Pat. No. 4,248,962 describes compounds that release photographically useful groups by means of an intramolecular nucleophilic displacement reaction in photographic materials. Other examples of means for release of photographically useful groups are described in, for example, U.S. Pat. Nos. 4,409,323 and 4,861,701. These compounds, particularly couplers, capable of releasing a photographically useful group provide a degree of control over timing and rate of release as well as rate of diffusion and distance of diffusion of the photographically useful group.

The part of the compound that remains in the photographic material after release of the photographically useful group (PUG) especially a development inhibitor group, and the dye that is formed in the material from reaction with oxidized color developer often provides undesired properties in the photographic material during or after photographic processing. For example the dye formed from a coupler upon release of a photographically useful group often adversely affects the desired image. One answer to this has been to provide a coupler that has a water solubilizing group on the parent coupler to enable the dye formed from the coupler to be washed-out of the photographic element upon photographic processing. Such couplers are described, for example, in U.S. Pat. Nos. 4,482,629 and 5,026,628.

A need has existed to provide a combination of couplers in a photographic material and process that enables formation of an improved image while enabling removal of wash-out dyes formed from the couplers during photographic processing. A need still exists to enable an imaging element within a photographic material capable of generating and receiving interlayer interimage effects by the use of silver development inhibitor groups with a high degree of control while enabling removal of unwanted dyes formed from compounds during photographic processing. Moreover, such needs have existed with the added parameter that such a combination of couplers must not require significant modification of the development inhibitor groups and such groups should not be released in a way that would adversely affect the ultimate end use of the groups.

The present invention enables these advantages by means of a color photographic element comprising a support bearing at least one photographic silver halide emulsion layer and a combination of at least two different couplers wherein (a) at least one of the couplers is a coupler (A) capable upon reaction with oxidized developer of forming a compound that is washed out of the photographic element during photographic processing and capable of release of a photographic development inhibitor group and (b) at least one of the couplers is a coupler (B) that upon reaction with oxidized developer is capable of releasing a coupling-off group that in sequence is capable of releasing a timing group and a photographic development inhibitor group or is capable of releasing a photographic development inhibitor group in the absence of a timing group. Such a combination of couplers is especially useful to enable improved tailoring of interlayer interimage effects in the color photographic element and process, such as the interimage effects between the green and red layers of a color photographic element This combination of couplers enables, for example, better control of color saturation, the sensitometric curve shape of the image and acutance of the image.

The coupler (A) can be any coupler that is capable upon reaction with oxidized developer, especially oxidized color developer, of forming a compound, preferably a dye, that is washed out of the photographic element during photographic processing and is capable of release of a photographic development inhibitor group. The coupler (A) can be, for example, represented by the formula:

$$(SOL)_y—COUP—(REL)_n—(TIME)_p—INH$$

wherein SOL is a water solubilizing group. SOL is known in the photographic art such as described in U.S. Pat. No. 5,026,628. The water solubilizing group can be selected from such groups as carboxyl, sulfo, and hydroxyl groups which may also form a salt as described in U.S. Pat. No. 4,482,629 (incorporated herein by reference) and is of sufficient hydrophilicity to impart good alkali solubility to the dye formed by the coupling reaction with an oxidized product of color forming developing agent with the coupler (A). Preferred SOL groups are $—CONH_2$, $—CONHCH_3$, $—CO_2H$, and —OH.

COUP is a coupler moiety, such as a cyan, magenta or yellow dye forming coupler moiety; REL is a releasing group known in the photographic art, such as described in U.S. Pat. No. 5,026,628, preferably containing a photographic ballast group; n and p individually are 0 or 1; and INH is a releasable development inhibitor group, also known in the photographic art. Typical development inhibitor groups include compounds having a heterocyclic ring as described in, for example, U.S. Pat. Nos. 4,782,012; 4,477,563; 4,886,736; 4,912,024; and 5,026,628, the disclosures of which are incorporated herein by reference. Preferred development inhibitor groups include mercaptotetrazoles, mercaptoxadiazoles, mercaptothiadiazoles and benzotriazoles.

The coupler (B) can be any coupler that upon reaction with oxidized developer is capable of releasing a coupling-off group that in sequence is capable of releasing a timing group, known in the photographic art, and a photographic development inhibitor group or is capable of releasing a photographic development inhibitor group in the absence of a timing group. The coupler (B) can be represented by the formula:

$$(SOL)_y—COUP—(TIME)_m—INH$$

wherein SOL is a water solubilizing group, as described; COUP is a coupler moiety, as described, such as a cyan, magenta or yellow dye forming coupler moiety, with the remainder of the molecule bonded at the coupling position; TIME is a releasable timing group capable upon photographic processing of timing release of INH, such as timing groups known in the photographic art, described in, for example, U.S. Pat. Nos. 4,409,323 and 4,248,962; and y and m are 0, 1 or 2.

Preferably, the color photographic element comprises a support bearing at least one photographic silver halide emulsion layer and a combination of at least two couplers (A) and (B), coupler (A) capable upon reaction with oxidized developer of forming a compound that is washed out of the photographic element during photographic processing and capable of releasing photographic development inhibitor or a timing group having a photographic development inhibitor, the timing group capable of providing timed release of said photographic development inhibitor and coupler (B) capable upon reaction with oxidized developer of forming a compound that is not washed out of the photographic element during photographic processing and capable of releasing a photographic development inhibitor with or without time delay, coupler (A) represented by the formula:

$$(SOL)_y—COUP—(REL)_n—(TIME)_p—INH$$

and coupler (B) represented by the formula:

$$COUP—(REL)_n—(TIME)_p—INH$$

wherein

SOL is a water solubilizing group;

COUP is a coupler moiety;

TIME is a timing group;

REL is a releasing group;

n and p individually are 0 or 1; and

INH is a releasable development inhibitor group; and y is 1 or 2.

In coupler (A) the ballast is located on the REL and in coupler (B) the ballast is not normally located on REL.

The term solubilizing group (SOL) herein means any water solubilizing group that enables the dye formed from the couplers, as described, to be washed out of the photographic element upon photographic processing. Such solubilizing groups are preferably amide groups, such as $CONH_2$ or $CONHCH_3$, or carboxy groups as noted. The coupler moiety can have one or more solubilizing groups. The number and type of water solubilizing groups on the couplers as described should not be sufficient to make the couplers mobile in the photographic element prior to exposure and processing. The described REL and TIME groups can also contain water solubilizing groups if desired.

The term REL group herein means any releasing group known in the photographic art that is bonded to the coupling position of the coupler moiety and is capable of being released upon oxidative coupling of the coupler. The REL is not a timing group that enables any significant delay of release of the described development inhibitor moiety during photographic processing. The REL group preferably comprises a photographic ballast group.

The term TIME group herein means any timing group known in the photographic art that enable timing of release of the development inhibitor group during photographic processing of the described photographic element. The timing group is one described in, for example, U.S Pat. Nos. 4,409,323; 4,248,962 and 5,026,628.

TIME referred to herein is delay of release as measured by half-life and can extend to, but not beyond the normal period of time required for developing the photographic element. That is, in the present invention at least half of the INH that is coupled off must be released at the end of the developing period. Delay of release of INH is usually not less than about 5 seconds, preferably is in the range of 5 to 600 seconds and typically in the range of 10 to 100 seconds. This can be determined in most cases in an aqueous solution at pH 10 or pH 14.

In the present invention, REL, i.e. release, of the timing group in the development of a photographic element is without substantial delay. Release of the timing group (as measured by half-life), can occur in not normally greater than 5 seconds, preferably less than 2 to 3 seconds, and typically less than 1 second half-life. As noted, the half-life can be determined in most cases in an aqueous solution at pH 10 or pH 14.

By "aqueous solution at pH 10" is meant an aqueous solution containing 3% Triton X-100, (a non-ionic surfactant, available from the Aldrich Chemical Co., Milwaukee, Wis.), at 23° C. and pH adjusted to 10 using phosphate buffer.

By "aqueous solution at pH 14" is meant an solution containing 45% acetonitrile and 55% aqueous 0.1N potassium hydroxide at 23° C.

A preferred coupler (A) is represented by the formula:

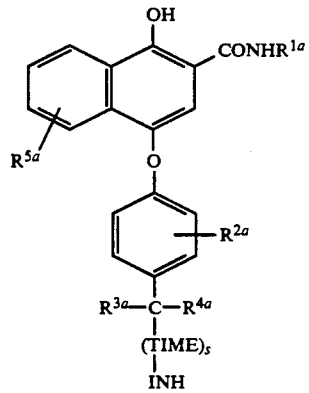

$R^{1a}$ can be hydrogen, alkyl containing 1-3 carbon atoms, or alkyl or aryl containing at least one solubilizing group as described; $R^{2a}$, $R^{3a}$ and $R^{4a}$ are individually hydrogen, substituted or unsubstituted alkyl or aryl, or a substituent which does not adversely affect the release of INH; $R^{5a}$ can be hydrogen, methyl, or a substituent such as $—NO_2$, Cl, $—NHSO_2R$, $—SO_2NHR$, $—OCH_3$, —NHCOR or —CONHR wherein R can be substituted or unsubstituted alkyl or aryl containing 1-10 carbon atoms and which does not adversely affect the release of INH nor the ability of the dye formed upon reaction with oxidized developer from washing out of the photographic element;

at least one of $R^{2a}$, $R^{3a}$ and $R^{4a}$ is a photographic ballast group;

s is 0 or 1; and

INH is a releasable development inhibitor group and may be selected from a mercaptotetrazole, mercaptooxadiazole, mercaptothiadiazole or benzotriazole inhibitor groups.

Another preferred coupler (A) is represented by the formula:

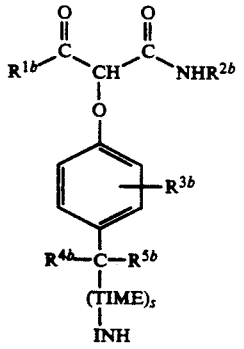

wherein $R^{1b}$ and $R^{2b}$ can be substituted or unsubstituted alkyl or aryl containing at least one solubilizing group as described;

$R^{3b}$, $R^{4b}$ and $R^{5b}$ are individually hydrogen, substituted or unsubstituted alkyl or aryl, or a substituent which does not adversely affect the release of INH;

at least one of $R^{3b}$, $R^{4b}$ and $R^{5b}$ is a photographic ballast group;

s is 0 or 1; and

INH is a development inhibitor group as described.

The term alkyl or aryl containing 1-10 carbon atoms herein means that the groups enable sufficient water solubility for the dye formed to be washed out of the photographic element upon processing which can for example, contain a water solublizing group.

And yet another preferred coupler (A), capable of forming a washout dye, is represented by the formula:

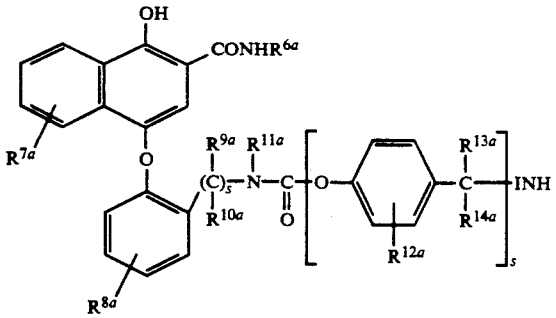

wherein $R^{6a}$ can be hydrogen, alkyl containing 1-3 carbon atoms, or substituted or unsubstituted alkyl or aryl containing at least one solubilizing group as described;

$R^{7a}$ or $R^{12a}$ can be hydrogen, methyl, or a substituent such as $-NO_2$, Cl, $-NHSO_2R^{15a}$, $-SO_2NHR^{15a}$, $-OCH_3$, $-NHCOR^{15a}$ or $-CONHR^{15a}$ wherein $R^{15a}$ can be substituted or unsubstituted alkyl or aryl containing 1-10 carbon atoms and which do not adversely affect the release of INH such as $-NO_2$, Cl, $-OCH_3$, $-CONHCH_3$, $NHCOCH_3$, $SO_2NHCH_3$;

$R^{8a}$ can be hydrogen, methyl, or a substituent such as $-NO_2$, Cl, $-NHSO_2R^{16a}$, $-SO_2NHR^{16a}$, $-OCH_3$, $-NHCOR^{16a}$ or $-CONHR^{16a}$ wherein $R^{16a}$ can be substituted or unsubstituted alkyl or aryl containing 1-40 carbon atoms;

$R^{9a}$, $R^{10a}$ and $R^{11a}$ can be hydrogen, methyl, substituted alkyl or aryl containing 1-40 carbon atoms;

at least one of $R^{8a}$, $R^{9a}$, $R^{10a}$ and $R^{11a}$ contains a photographic ballast;

s can be 0 or 1

$R^{13a}$ or $R^{14a}$ can be hydrogen, methyl, substituted or unsubstituted alkyl or aryl containing 1-10 carbon atoms;

INH is a releasable development inhibitor group as described previously.

It will be appreciated that the first part of the coupling off group directly bonded to the coupling position of the coupler may contain a carbamate type group releasing through intramolecular cyclisation reaction which may be replaced with a quinone-methide group or other such group releasing through an elimination reaction.

A preferred coupler (B), which forms a dye that does not washout, is represented by the formula:

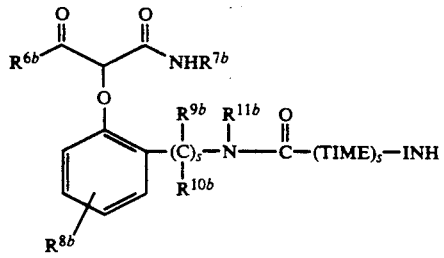

wherein $R^{6b}$ or $R^{7b}$ can be substituted or unsubstituted alky or aryl containing 1-40 carbon atoms, optionally substituted with substituents such as $-OCH_3$, $-NO_2$, Cl, $-NHSO_2R^{12B}$, $-SO_2NHR^{12b}$, $-CONHR^{12b}$, or $-NHCOR^{12b}$ wherein $R^{12b}$ can be substituted or unsubstituted alkyl or aryl containing 1-40 carbon atoms;

$R^{8b}$ can be hydrogen, methyl, or a substituent such as $-NO_2$, Cl, $-NHSO_2R^{15a}$, $-SO_2NHR^{15a}$, $-OCH_3$, $-NHCOR^{15a}$ or $-CONHR^{15a}$ wherein $R^{15a}$ can be substituted or unsubstituted alkyl or aryl containing 1-10 carbon atoms and which do not adversely affect the release of INH such as $-NO_2$, Cl, $-OCH_3$, $-CONHCH_3$, $NHCOCH_3$, $SO_2NHCH_3$;

$R^{9b}$ and $R^{10b}$ can be hydrogen, methyl, substituted or unsubstituted alkyl or aryl containing 1-10 carbon atoms;

$R^{11b}$ can be methyl, substituted alkyl or aryl containing 1-10 carbon atoms;

s is 0 or 1;

INH is a development inhibitor group as described previously; and wherein at least one of $R^{6b}$ and $R^{7b}$ comprises a ballast group.

Another preferred coupler (B), which forms a dye that does not washout is represented by the formula:

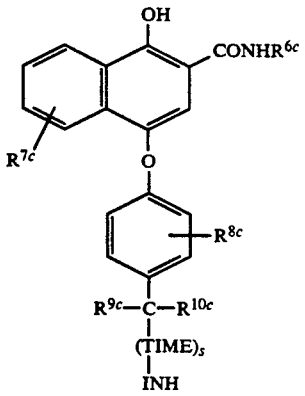

wherein $R^{6c}$ can be substituted or unsubstituted alky or aryl containing 1–40 carbon atoms, optionally substituted with substituents such as $—OCH_3$, $—NO_2$, Cl, $—NHSO_2R^{12B}$, $—SO_2NHR^{12b}$, $—CONHR^{12b}$, or $—NHCOR^{12b}$ wherein $R^{12b}$ can be substituted or unsubstituted alkyl or aryl containing 1–40 carbon atoms;

$R^{7c}$ can be hydrogen, methyl, or a substituent such as $—NO_2$, $—OCH_3$, Cl, $—NHSO_2R^{11c}$, $—SO_2NHR^{11c}$, $—NHCOR^{11c}$ or $—CONHR^{11c}$ wherein $R^{11c}$ can be substituted or unsubstituted alkyl or aryl containing 1–40 carbon atoms;

$R^{8c}$ can be hydrogen, methyl, or a substituent such as $—NO_2$, Cl, $—NHSO_2R^{15a}$, $—SO_2NHR^{15a}$, $—OCH_3$, $—NHCOR^{15a}$ or $—CONHR^{15a}$ wherein $R^{15a}$ can be substituted or unsubstituted alkyl or aryl containing 1–10 carbon atoms and which do not adversely affect the release of INH such as $—NO_2$, Cl, $—OCH_3$, $—CONHCH_3$, $NHCOCH_3$, $SO_2NHCH_3$;

$R^{9c}$ and $R^{10c}$ can be hydrogen, methyl, substituted or unsubstituted alkyl or aryl containing 1–10 carbon atoms;

s is 0 or 1; and

INH is a releasable development inhibitor group as described previously; and wherein at least one of $R^{6c}$ and $R^{7c}$ comprises a ballast group.

When the coupler (B) does not contain a timing group that enables timing of the release of the development inhibitor group a preferred coupler (B) is represented by the formula:

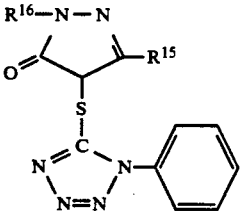

wherein $R^{15}$ is an amino or

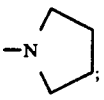

and $R^{16}$ is a photographic ballast group.

Other preferred couplers (B) which may be used with couplers (A) are selected from the following:

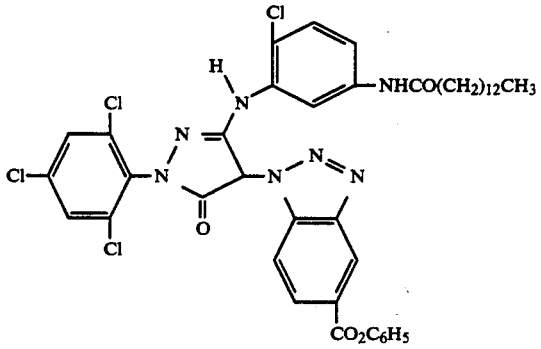

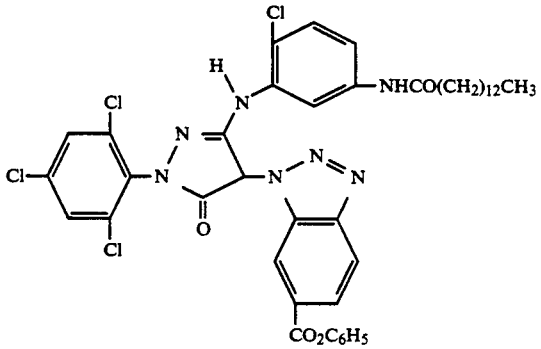

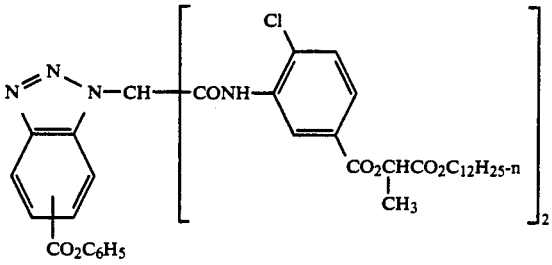

Preferred examples of coupler (A) are as follows:

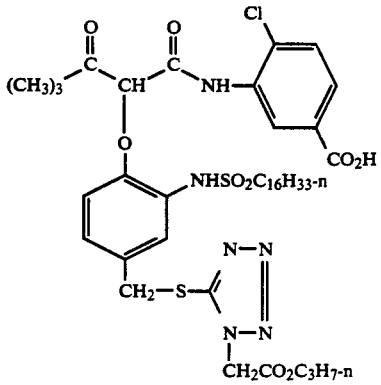

-continued
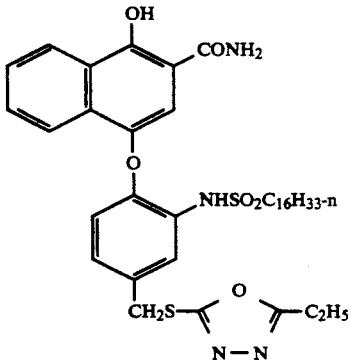
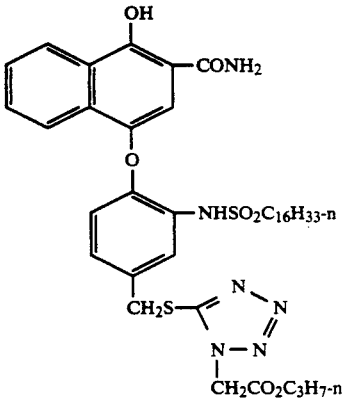
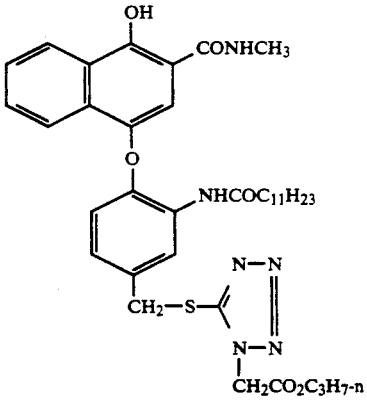
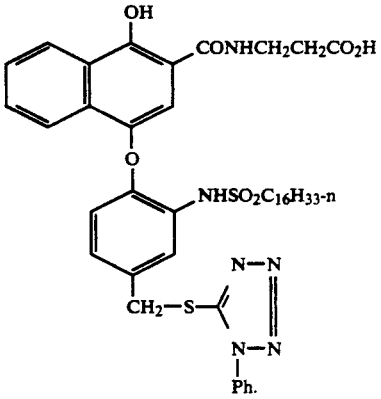
-continued
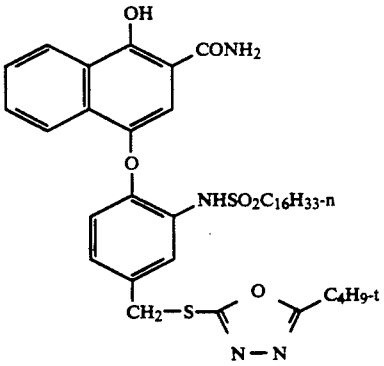
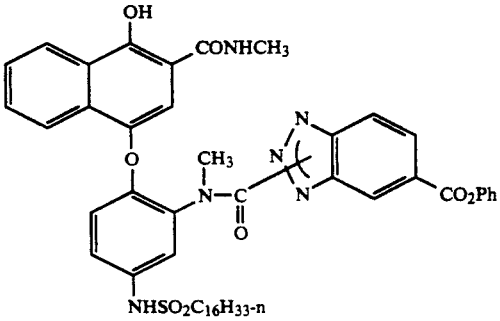
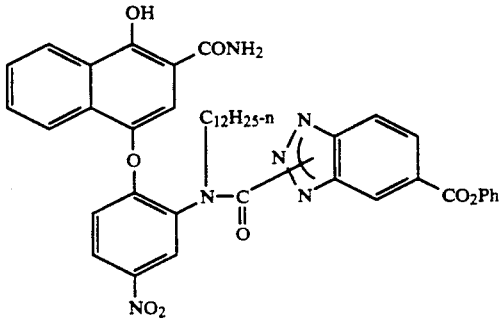
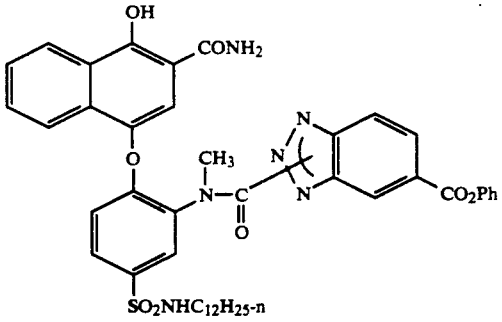
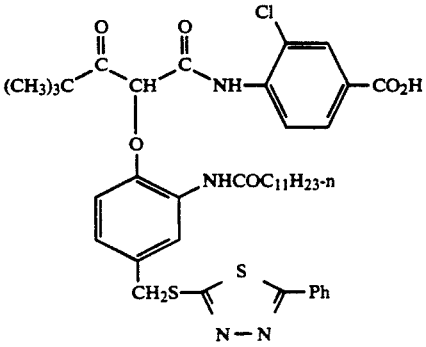

-continued
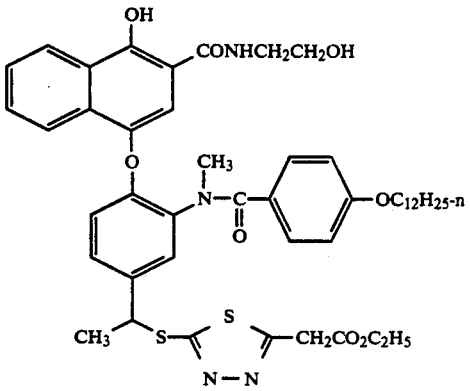
Preferred examples of coupler (A) having timing groups are as follows:
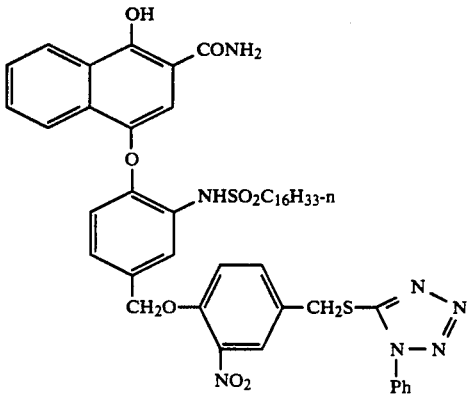
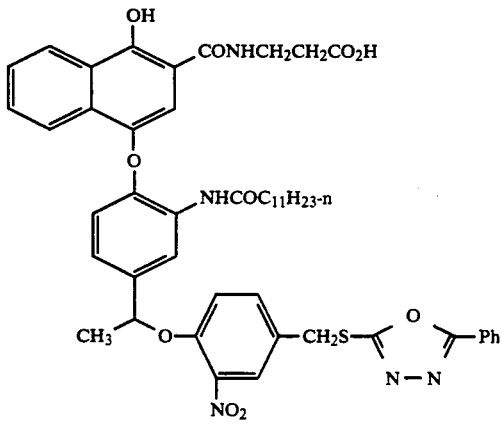
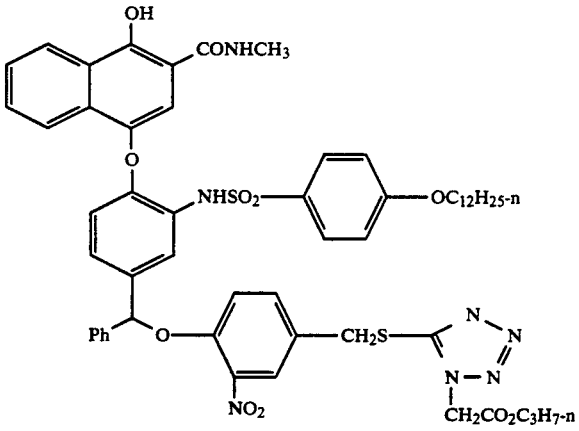
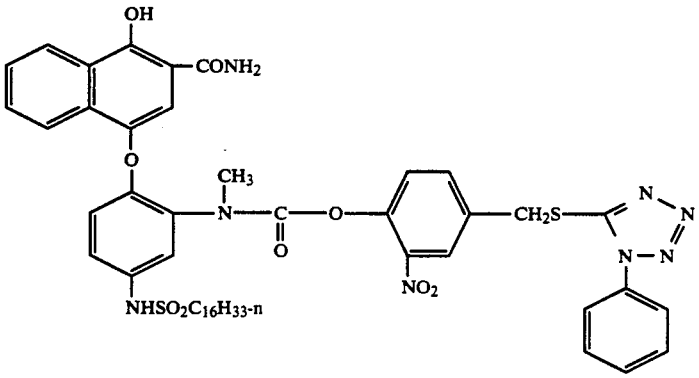

-continued
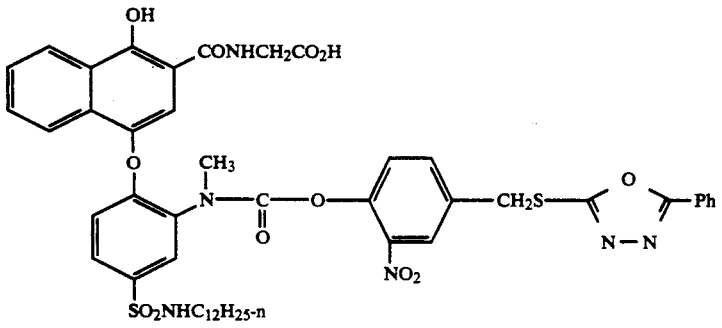
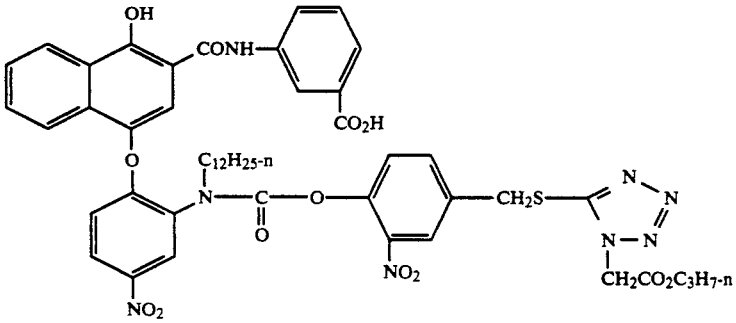
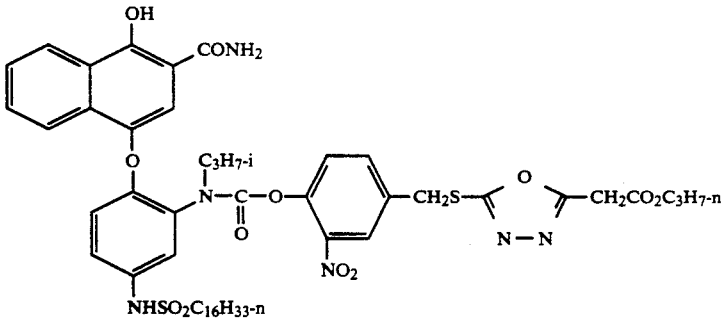
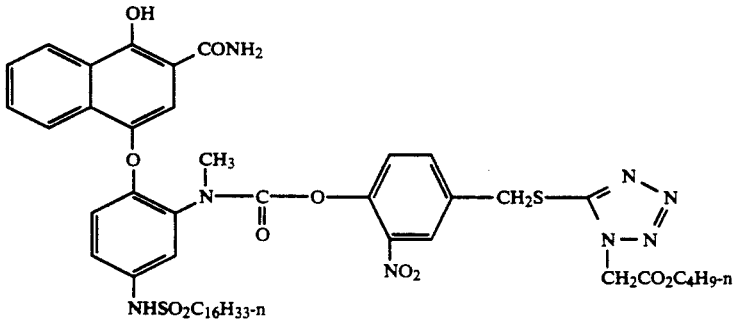

-continued
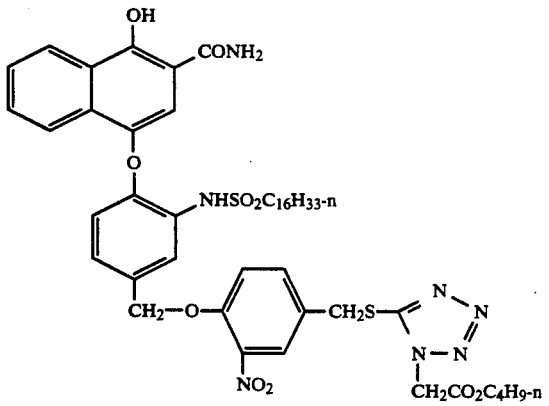
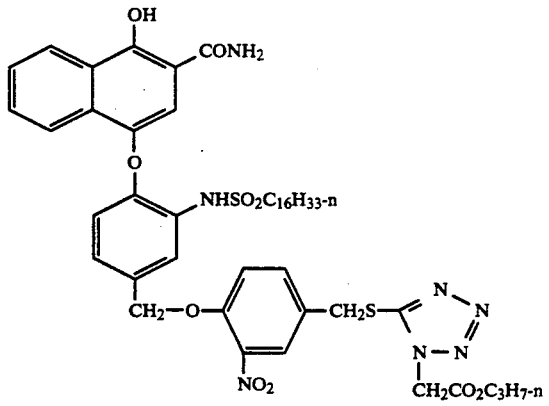
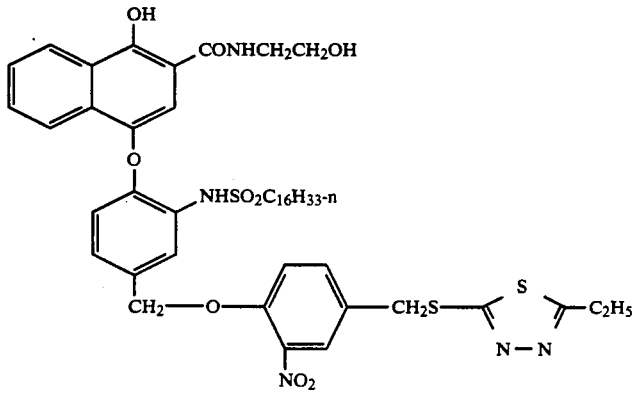
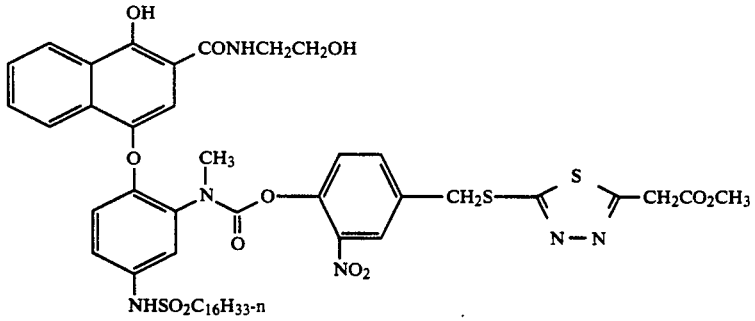
Preferred examples of couplers (B) are as follows:
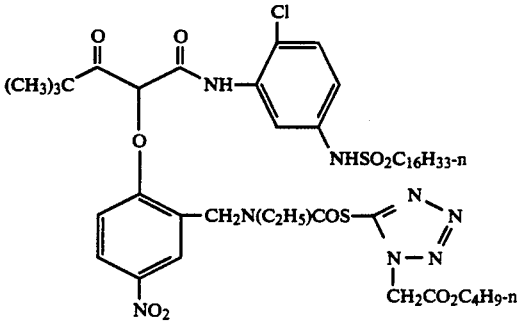
-continued
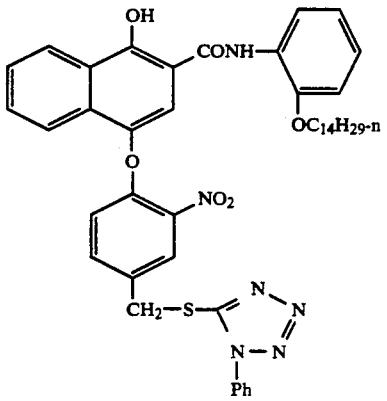

-continued

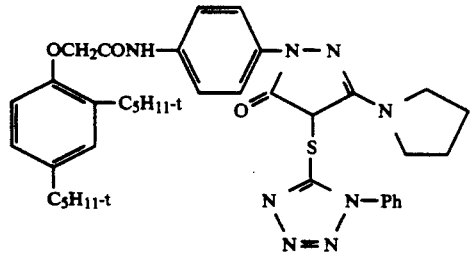

While above compounds have been shown using a nitro group, it will be appreciated that other electron withdrawing groups such as sulfones, nitriles and halogens such as chlorine can be used.

A preferred embodiment of the invention is a color photographic element comprising a support bearing at least one red sensitive photographic silver halide emulsion layer comprising at least one cyan image dye-forming coupler;

at least one green sensitive photographic silver halide emulsion layer comprising at least one magenta image dye-forming coupler, such as a pyrazolone, a pyrazolotriazole or polymeric magenta image dye-forming coupler, and a combination of couplers (A) and (B) as described; and, at least one blue sensitive photographic silver halide emulsion layer comprising at least one yellow image dye-forming coupler. The combination of the couplers (A) and (B) in at least one of the magenta image dye-forming layers is especially useful to enable advantageous interimage effects that provide improved color images.

The ratios and concentrations of the couplers (A) and (B) in the described photographic element can vary depending upon such factors as the desired image, the particular silver halide emulsions in the element, photographic processing, the strength of the development inhibitor, other components in the element, and the like. The ratio of coupler (A) to (B) can be within the range of 0.1 to 20, preferrably 0.3 to 15, and typically 0.3 to 10.

The hue of the color image in a layer containing couplers (A) and (B) can be the same as or different from the hues of the dyes formed from the couplers (A) and (B). For example, the couplers (A) and (B) can form a cyan colored dye in layer comprising an image dye-forming coupler that forms a magenta dye image. Couplers (A) and (B) form no permanent dyes and can be used in or in associative contact with any dye forming element.

As used herein, a ballast group is known in the photographic art. The photographic ballast group as described is an organic group of such size and configuration as to confer on the molecule sufficient bulk to render the molecule substantially non-diffusible from the layer in which it is coated in a photographic element. Representative ballast groups include substituted or unsubstituted alkyl, aryl, ester, carbonamide, carbamoyl, sulfonamide, sulfamoyl, sulfone, sulfoxide and alkoxy groups typically containing 8 to 40 carbon atoms.

As used herein the terms "coupler" and "coupler compound" refer to the entire compound, including the coupler moiety and the coupling-off group including the INH. The term "coupler moiety" refers to that portion of the compound other than the coupling-off group.

The coupler moiety (COUP) can be any moiety that will react with oxidized color developing agent to cleave the bond between the coupling-off group and the coupler moiety. The coupler moiety herein includes coupler moieties employed in conventional color-forming couplers that yield colorless products on reaction with oxidized color developing agents as well as coupler moieties that yield colored products on reaction with oxidized color developing agents. Both types of coupler moieties are well known to those skilled in the photographic art.

The coupler moiety can be ballasted or unballasted provided that the dye formed upon oxidative coupling with the unballasted coupler is capable of being washed out of the photographic element. It can be monomeric, or it can be part of a dimeric, oligomeric or polymeric coupler.

The photographic element can also comprise a coupler that is capable of releasing another photographic reagent or a photographic dye. A photographic reagent herein is a moiety that upon release further reacts with components in the photographic element, such as a development inhibitor, a development accelerator, a bleach inhibitor, a bleach accelerator, a coupler (for example, a competing coupler, a dye-forming coupler, or a development inhibitor releasing coupler [DIR coupler]), a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer or a desensitizer.

The INH can be present in the coupling-off group as a preformed species or it can be present in a blocked form or as a precursor. The INH can be in particular a preformed development inhibitor or the development inhibiting function can be blocked.

There follows a listing of patents and publications that describe representative COUP groups useful in the invention:

I. COUP's

A. Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999 and "Farbkuppler-eine Literaturübersicht," published in Agfa Mitteilungen, Band III, pp. 156–175 (1961). Preferably such couplers are phenols and naphthols that form cyan dyes on reaction with oxidized color developing agent.

B. Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler-eine Literaturübersicht," published in Agfa Mitteilungen, Band III, pp. 126–156 (1961).

Preferably such couplers are pyrazolones and pyrazolotriazoles that form magenta dyes upon reaction with oxidized color developing agents.

C. Couplers which form yellow dyes upon reaction with oxidized and color developing agent are described in such representative patents and publications as: U.S. Pat. Nos. 2,875,057; 2,407,210; 3,265,506; 2,298,443;

3,048,194; 3,447,928 and "Farbkuppler-eine Literaturü bersicht, published in Agfa Mitteilungen, Band III, pp. 112–126 (1961).

Preferably such yellow-dye forming couplers are acylacetamides, such as benzolyacetamides and pivaloylacetamides.

D. Couplers which form colorless products upon reaction with oxidized color developing agent are described in such representative patents as: U.K. Patent No. 861,138; U.S. Pat. Nos. 3,632,345; 3,928,041; 3,958,993 and 3,961,959.

INH can be any releasable development inhibitor group. Typical INH groups are described in, for example U.S. Patents 4,477,563; 4,782,012; 4,886,736; 4,912,024; 4,959,299; and 5,026,628; the disclosures of which are incorporated herein by reference. Preferred development inhibitor groups are heterocyclic inhibitor groups which for example, include mercaptotetrazoles, mercaptoxadiazoles, mercaptothiadiazoles and benzotriazoles. Structures A-1 through A-8 as follows, represent typical releasable development inhibitor groups.

A-1

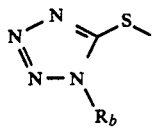

A-2

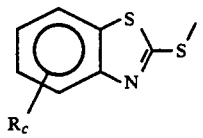

A-3

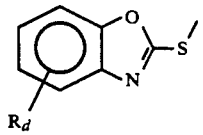

A-4

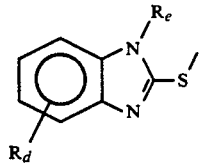

A-5

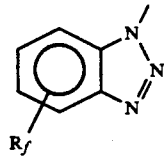

A-6

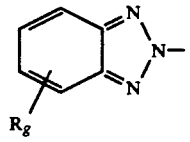

A-7

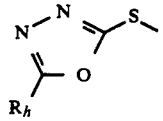

-continued

A-8

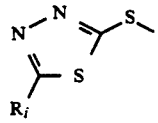

wherein:

$R_b$, $R_e$, $R_h$, and $R_i$ are individually hydrogen, substituted or unsubstituted alkyl of 1 to 8 carbon atoms such as methyl, ethyl, propyl, butyl, 1-ethylpentyl, 2-ethoxyethyl, substituted phenyl, unsubstituted phenyl; substituted or unsubstituted phenyl of 6 to 10 carbon atoms; alkylthio, such as methyl, ethyl, propyl, butyl or octylthio; or alkyl esters such as $-CO_2CH_3$, $-CO_2C_2H_5$, $-CO_2C_3H_7$, $-CO_2C_4H_9$, $-CH_2CO_2CH_3$, $-CH_2CO_2C_2H_5$, $-CH_2CO_2C_3H_7$, $-CH_2CO_2C_4H_9$, $-CH_2CH_2CO_2CH_3$, $-CH_2CH_2CO_2C_2H_5$, $-CH_2CH_2CO_2C_3H_7$, and $-CH_2CH_2CO_2C_4H_9$; or aryl esters such as $-CO_2R_j$, $-CH_2CO_2R_j$, $-CH_2CH_2CO_2R_j$, wherein $R_j$ is substituted or unsubstituted aryl;

wherein:

$R_c$, $R_d$, $R_f$, and $R_g$ are as described for $R_b$, $R_e$, $R_h$, and $R_i$; or, are individually one or more halogen such as chloro, fluoro, or bromo; carboxyl, esters or other substituents such as $-NHCOCH_3$, $-SO_2OCH_3$, $-OCH_2CH_2SO_2CH_3$, $-OCOCH_2CH_3$, $-NHCOCH_3$ or nitro groups.

The photographic couplers of the invention can be incorporated in photographic elements by means and precesses known in the photographic art. In a photographic element prior to exposure and processing the photographic coupler should be of such size and configuration that it will not diffuse through the photographic layers.

Photographic elements of this invention can be processed by conventional techniques in which color forming couplers and color developing agents are incorporated in separate processing solutions or compositions or in the element.

Photographic elements in which the compounds of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer, where they will come into reactive association with oxidized color developing agent which has developed silver halide in the emulsion layer. The silver halide emulsion layer can contain or have associated with it, other photographic coupler compounds, such as dye-forming couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

Each silver halide emulsion unit can be composed of one or more layers and the various units and layers can be arranged in different locations with respect to one another.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. Especially preferred are the combinations of T-grains and conventional emulsions. Highly preferred are T-grains and conventional emulsions with high cubic character. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure*, January 1983, Item No. 22534 and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers and the like.

The photographic couplers as described, can be used in photographic elements in the same way as photographic couplers which release development inhibitor groups. However, because of the improved ability to control the release of the INH, couplers of the invention permit enhanced effects or more selective effects.

Couplers as described which release a development inhibitor can be contained in, or in reactive association with, one or more of the silver halide emulsion units in a color photographic element. If the silver halide emulsion unit is composed of more than one layer, one or more of such layers can contain the couplers as described and preferred is the use of segregated layers, by relative sensitivity, of emulsions with the same spectral sensitivity. The layers can contain other photographic couplers conventionally used in the art. In the following discussion of suitable materials for use in the emulsions and elements of this invention, reference will be made to *Research Disclosure*, December 1978, Item 17643, published by Industrial Opportunities Ltd., Homewell Havent, Hampshire, P09 lEF, U.K., the disclosures of which are incorporated herein by reference. This publication will be identified hereafter by the term "Research Disclosure".

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and the processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethylaniline hydrochloride; 4-amino-3-methyl-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-3-β-(methanesulfonamido)-ethyl-N,N-diethylaniline hydrochloride; and 4-amino-N-ethyl-N-(2-methoxyethyl)-m-toluidine di-p-toluenesulfonic acid.

The described photographic materials and processes can be used with photographic silver halide emulsions and addenda known to be useful in the photographic art, as described in, for example, *Research Disclosure*, December 1989, Item No. 308,119, the disclosures of which are incorporated herein by reference.

With negative working silver halide, the processing step described above gives a negative image. To obtain a positive (or reversal) image, this step can be preceded by development with a non-chromogenic developing agent to develop exposed silver halide, but not form a dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Compounds as described can be prepared by reactions and methods known in the organic compound synthesis art described in U.S. patent application, Ser. No.724553, the disclosures of which are incorporated herein by reference.

Photographic elements in which the DIR compounds of this invention are incorporated are preferably multilayer, multicolor elements. The DIR compounds of this invention can release development inhibitors to enhance the effect of intralayer acutance, as well as causing interimage to other layers for acutance and color corrections of other color records. In addition to the effects mentioned above, these DIR compounds are extremely effective to make their own color record a very good receiver of the interlayer interimage effect (IIE). As a consequence of this increased ability to receive IIE, acutance and color saturation are significantly improved.

The following examples further illustrate the invention.

EXAMPLE 1

The following examples and data illustrate color photographic material comprising a combination of couplers as described.

On a cellulose triacetate film support were coated the following layers: (coverages are in grams per meter squared).

Layer 1 (Antihalation Layer)

Black colloidal silver sol containing 0.323 g/m$^2$ of silver and 2.691 g/m$^2$ gelatin.

Layer 2 (Slow Cyan Layer)

A blend of two red-sensitized silver iodobromide grains, a medium sized tabular emulsion (3.0 mole % iodide) at 1.3 g/m$^2$ and a smaller cubic emulsion (3.5 mole % iodide) at 1.1 g/m$^2$, gelatin at 3.0 g/m$^2$, cyan image-forming coupler C-1 at 0.87 g/m$^2$, DIR coupler D-1 at 0.065 g/m$^2$, bleach accelerator releasing coupler D-2 at 0.01 g/m$^2$ and antifoggant 4-hydroxy-6-methyl-1,3,3a,7-tetraazaindene at 0.036 g/m$^2$.

Layer 3 (Fast Cyan Layer)

Red-sensitized tabular silver iodobromide emulsion (6.0 mole % iodide) at 0.81 g/m$^2$, cyan dye-forming image coupler C-1 at 0.151 g/m$^2$, DIR compound D-1 at 0.065 g/m$^2$, D-3 at 0.032 g/m$^2$, gelatin at 1.68 g/m$^2$, and antifoggant 4-hydroxy-6-methyl-1-1,3,3a,7-tetraazaindene at 0.036 g/m$^2$.4-hydroxy-6-methyl-1,3,3a,7-tetraazaindene at 0.036 g/m$^2$.

Layer 4 (Interlayer)

Oxidized developer scavenger, N,N-(4-hydroxy-1,3-phenylene)bis[4-(dodecyloxy)benzenesulfonamide], at 0.054 g/m$^2$ and gelatin at 1.3 g/m$^2$.

Layer 5 (Slow Macenta Layer)

Green-sensitized tabular silver iodobromide emulsion (6.0 mole % iodide) at 0.54 g/m$^2$, green-sensitized tabular emulsion (1.5 mole % iodide) at 0.26 g/m$^2$, magenta dye-forming image coupler M-1 at 0,344 g/m$^2$, DIR compound (DIR-1) at 0.075 g/m$^2$, masking coupler M-2 at 0.108 g/m$^2$, gelatin at 1.64 g/m$^2$, and antifoggant 4-hydroxy-6-methyl-1,3,3a,7-tetraazainde at 0.036 g/m$^2$.

Layer 6 (Fast Macenta Layer)

A blend of two green-sensitized tabular silver iodobromide grains, a fast emulsion (3.0 mole % iodide) at 0.754 g/m$^2$, a medium speed emulsion (3.0 mole % iodide) at 0.538 g/m$^2$, magenta dye-forming image coupler M-1 at 0.151 g/m$^2$, masking coupler M-2 at 0.065 g/m$^2$, gelatin at 1.40 g/m2, DIR coupler(s) as described in Table I, and antifoggant 4-hydroxy-6-methyl-1,3,3a,7-tetraazaindene at 0.036 g/m$^2$.

Layer 7 (Yellow Filter Layer)

Gelatin at 0.86 g/m$^2$, Carey Lea silver at 0.043 g/m$^2$, and oxidized developer scavenger, N,N-(4-hydroxy-1,3-phenylene)bis[4-(dodecyloxy)benzenesulfonamide], at 0.054 g/m$^2$.

Layer 8 (Slow Yellow Layer)

Blue-sensitized tabular silver iodobromide emulsion (3.0 mole % iodide) at 0.36 g/m2, blue-sensitized tabular silver bromoiodide emulsion (3.0 mole % iodide) at 0.10 g/m$^2$, gelatin at 1.73 g/m$^2$, yellow dye-forming image coupler Y-1 at 0.883 g/m$^2$, DIR coupler D-4 at 0.097 g/m$^2$.

Layer 9 (Fast Yellow Layer)

Blue-sensitized tabular silver iodobromide emulsion (3.0 mole % iodide) at 0.43 g/m$^2$, gelatin at 0.807 g/m$^2$, yellow dye-forming image coupler Y-1 at 0.513 g/m$^2$, DIR coupler D-4 at 0.032 g/m$^2$.

Layer 10 (Protective Overcoat and UV Filter Layer)

Gelatin at 1.24 g/m$^2$, silver bromide Lippmann emulsion at 0.23 g/m$^2$, UV absorbers at 0.23 g/m$^2$, and bis(-vinylsulfonyl)methane added at 1.8% of total gelatin weight.

A photographic recording material, was prepared in a manner as described. The following modifications were made in the Layer 6 (Fast Magenta Layer):

The combinations of couplers described in Table 1 were used. The results are given in the following Table 1 at the concentrations used.

The following example and data illustrate a color photographic element comprising a combination of DIR couplers both of which form a wash-out dye. The results of Example 1 are given in the following Table I:

TABLE I

| Expt. No. | Layer 6 (U)DIR Laydown (mg/m$^2$) | Gamma[1] G of G | Gamma[2] G of N | Gamma[3] Ratio | Gamma[4] R of N |
|---|---|---|---|---|---|
| 1 | UDIR-6 (66.7) + UD.IR-1 (0) | 1.40 | 0.64 | 2.19 | 0.590 |
| 2 | UDIR-6 (50.1) + UDIR-1 (8.6) | 1.48 | 0.64 | 2.31 | 0.577 |
| 3 | UDIR-6 (33.4) + UDIR-1 (17.2) | 1.60 | 0.64 | 2.50 | 0.548 |
| 4 | UDIR-6 (16.7) + UDIR-1 (25.8) | 1.66 | 0.64 | 2.59 | 0.536 |
| 5 | UDIR-6 (0) + UDIR-1 (34.4) | 1.77 | 0.67 | 2.64 | 0.528 |

[1]Green contrast obtained from a green light only exposure.

[2]Green contrast obtained from a white light exposure.

[3] $\frac{\text{Gamma G of G}}{\text{Gamma G of N}}$

[4]Red contrast obtained from a white light only exposure.

This data illustrates that green interimage effect, as measured by gamma ratios, increases as the level of the coupler UDIR-1 increased. The contrast of the red image was also reduced as the level of coupler UDIR-1 was increased. The reduction of the red record contrast is an indication of green onto red interlayer interimage.

EXAMPLE 2

The following example and data illustrate a color photographic element comprising a combination of a DIR coupler that does not form a wash-out type dye with an acetanilide type DIR coupler that forms a washout type dye.

The procedure described in Example 1 was repeated with coupler DIR-1 and coupler UDIR-5 that is an acetanilide coupler. The results of this procedure are given in following Table II:

TABLE II

| Expt. No. | Layer 6 (U)DIR Laydown (mg/m$^2$) | Gamma G of G | Gamma G of N | Gamma Ratio |
|---|---|---|---|---|
| 1 | DIR-1 (43.1) + UDIR-5 (0) | 1.33 | 0.71 | 1.87 |
| 2 | DIR-1 (32.3) + UDIR-5 (8.6) | 1.42 | 0.71 | 2.00 |
| 3 | DIR-1 (21.5) + UDIR-5 (17.2) | 1.56 | 0.73 | 2.14 |
| 4 | DIR-1 (10.8) + UDIR-5 (25.8) | 1.72 | 0.75 | 2.29 |
| 5 | DIR-1 (0) + UDIR-5 (34.4) | 2.00 | 0.79 | 2.53 |

This data illustrates the effectiveness of the combination of DIR-1 with UDIR-5 in control of interimage effects.

EXAMPLE 3

The following example and data illustrate a color photographic element comprising a combination of two DIR couplers each of which forms a wash-out type dye.

The procedure described in Example 1 was repeated with the couplers UDIR-1 and UDIR-2 at the concentration given in following Table III:

TABLE III

| Expt. No. | Layer 6 (U)DIR Laydown (mg/m²) | Gamma G of G | Gamma G of N | Gamma Ratio | Gamma R of N |
|---|---|---|---|---|---|
| 1 | UDIR-2 (0) + UDIR-1 (34.4) | 1.75 | 0.74 | 2.37 | 0.66 |
| 2 | UDIR-2 (32.3) + UDIR-1 (25.8) | 1.50 | 0.71 | 2.11 | 0.65 |
| 3 | UDIR-2 (64.6) + UDIR-1 (17.2) | 1.31 | 0.71 | 1.86 | 0.60 |
| 4 | UDIR-2 (96.9) + UDIR-1 (8.6) | 1.17 | 0.71 | 1.65 | 0.58 |
| 5 | UDIR-2 (129.2) + UDIR-1 (0) | 1.11 | 0.71 | 1.56 | 0.54 |

EXAMPLE 4

The following example and data illustrate a color photographic element comprising another combination of DIR couplers in which both couplers form wash-out dyes.

The procedure described in Example 1 was repeated with the replacement of the noted DIR couplers with the DIR coupler listed in the following Table IV:

TABLE IV

| Expt. No. | Layer 6 (U)DIR Laydown (mg/m²) | Gamma G of G | Gamma G of N | Gamma Ratio | Gamma R of N |
|---|---|---|---|---|---|
| 1 | UDIR-2 (0) + UDIR-4 (17.2) | 1.86 | 0.64 | 2.91 | 0.590 |
| 2 | UDIR-2 (21) + UIDR-4 (12.9) | 1.80 | 0.64 | 2.81 | 0.577 |
| 3 | UDIR-2 (42) + UDIR-4 (8.6) | 1.76 | 0.65 | 2.71 | 0.548 |
| 4 | UDIR-2 (63) + UDIR-4 (4.3) | 1.63 | 0.65 | 2.51 | 0.536 |
| 5 | UDIR-2 (84) + UDIR-4 (0) | 1.56 | 0.65 | 2.40 | 0.528 |

EXAMPLES 5-8

The following examples and data illustrate a color photographic element comprising other combinations of DIR couplers.

The procedure described in Example 1 was repeated with the replacement of the noted DIR couplers with the DIR couplers listed in Tables V-VIII. Table V is another example in which both DIR couplers form wash-out dyes. Tables VI-VIII are examples in which one of the DIR couplers forms a wash-out dye while the second forms a dye which does not wash-out.

TABLE V

| Expt. No. | Layer 6 (U)DIR Laydown (mg/m²) | Gamma G of G | Gamma G of N | Gamma Ratio | Gamma R of N |
|---|---|---|---|---|---|
| 1 | UDIR-3 (0) + UDIR-1 (34.4) | 1.65 | 0.69 | 2.39 | 0.642 |
| 2 | UDIR-3 (20.1) + UDIR-1 (25.8) | 1.42 | 0.72 | 1.97 | 0.625 |
| 3 | UDIR-3 (40.3) + UDIR-1 (17.2) | 1.29 | 0.71 | 1.82 | 0.587 |
| 4 | UDIR-3 (60.4) + UDIR-1 (8.6) | 1.24 | 0.70 | 1.77 | 0.573 |
| 5 | UDIR-3 (80.5) + UDIR-1 (0) | 1.17 | 0.71 | 1.65 | 0.543 |

TABLE VI

| Expt. No. | Layer 6 (U)DIR Laydown (mg/m²) | Gamma G of G | Gamma G of N | Gamma Ratio | Gamma R of N |
|---|---|---|---|---|---|
| 1 | DIR-1 (43.1) + UDIR-1 (0) | 1.41 | 0.72 | 1.96 | 0.640 |
| 2 | DIR-1 (32.3) + UDIR-1 (8.6) | 1.60 | 0.74 | 2.16 | 0.638 |
| 3 | DIR-1 (21.5) + UDIR-1 (17.2) | 1.80 | 0.76 | 2.37 | 0.604 |
| 4 | DIR-1 (10.8) + UDIR-1 (25.8) | 2.10 | 0.79 | 2.66 | 0.537 |
| 5 | DIR-1 (0) + UDIR-1 (34.4) | 2.30 | 0.81 | 2.84 | 0.533 |

TABLE VII

| Expt. No. | Layer 6 (U)DIR Laydown (mg/m²) | Gamma G of G | Gamma G of N | Gamma Ratio | Gamma R of N |
|---|---|---|---|---|---|
| 1 | DIR-2 (62.4) + UDIR-4 (0) | 1.58 | 0.76 | 2.08 | 0.57 |
| 2 | DIR-2 (46.8) + UDIR-4 (4.1) | 1.62 | 0.75 | 2.16 | 0.60 |
| 3 | DIR-2 (31.2) + UDIR-4 (8.1) | 1.72 | 0.71 | 2.42 | 0.62 |
| 4 | DIR-2 (15.6) + UDIR-4 (12.2) | 1.76 | 0.79 | 2.51 | 0.66 |
| 5 | DIR-2 (0) + UDIR-4 (16.2) | 1.83 | 0.72 | 2.54 | 0.67 |

TABLE VIII

| Expt. No. | Layer 6 (U)DIR Laydown (mg/m²) | Gamma G of G | Gamma G of N | Gamma Ratio | Gamma R of N |
|---|---|---|---|---|---|
| 1 | DIR-3 (0) + UDIR-4 (17.2) | 1.85 | 0.66 | 2.81 | 0.76 |
| 2 | DIR-3 (14.5) + UDIR-4 (12.9) | 1.74 | 0.66 | 2.64 | 0.74 |
| 3 | DIR-3 (29.1) + UDIR-4 (8.6) | 1.62 | 0.65 | 2.49 | 0.72 |
| 4 | DIR-3 (43.6) + UDIR-4 (4.3) | 1.50 | 0.64 | 2.34 | 0.71 |
| 5 | DIR-3 (58.1) + UDIR-4 (0) | 1.44 | 0.65 | 2.22 | 0.71 |

The structures of the couplers used in the examples were as follows:
C-1
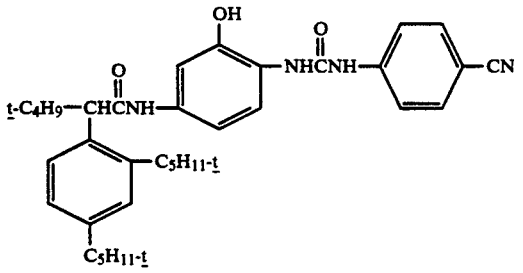
M-1
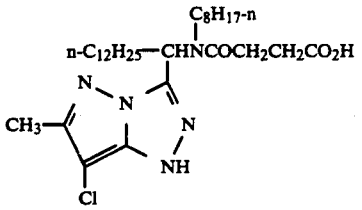
M-2
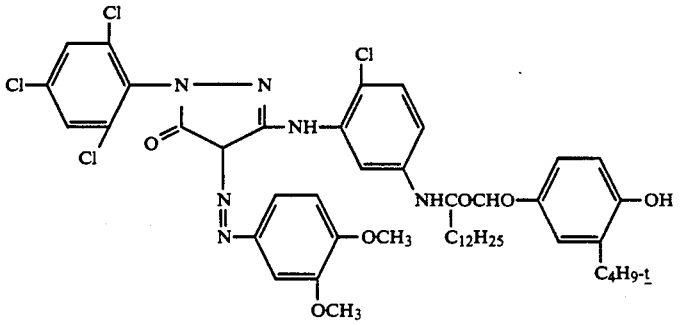
Y-1
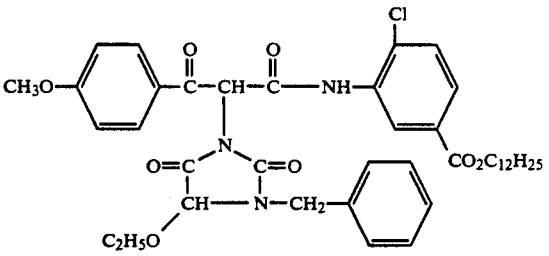
D-1
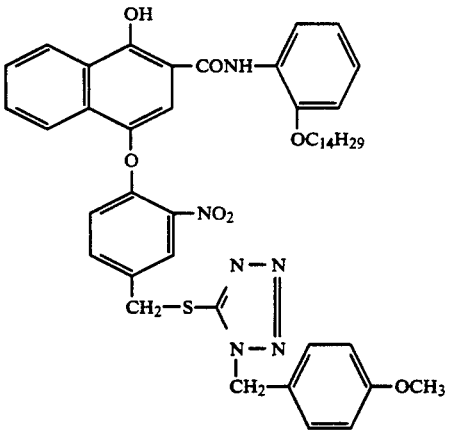
D-2
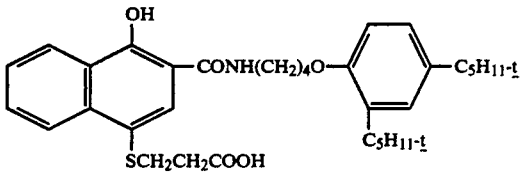
D-3
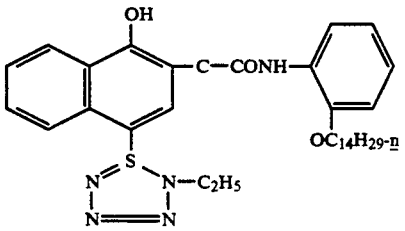
D-4

-continued
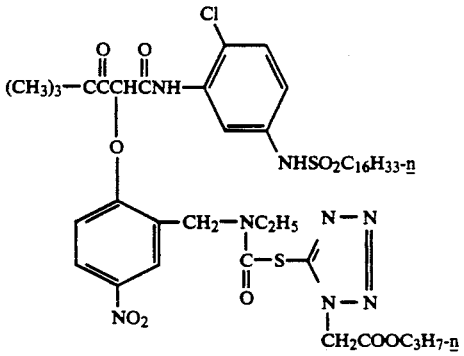
DIR-1:
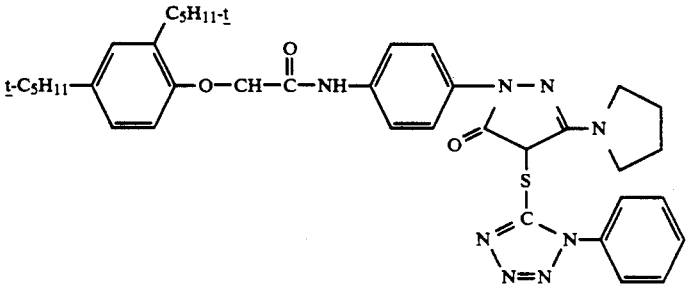
DIR-2:
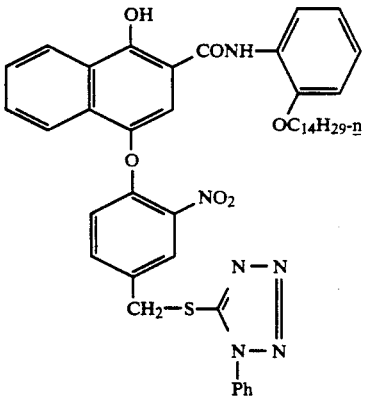
DIR-3:
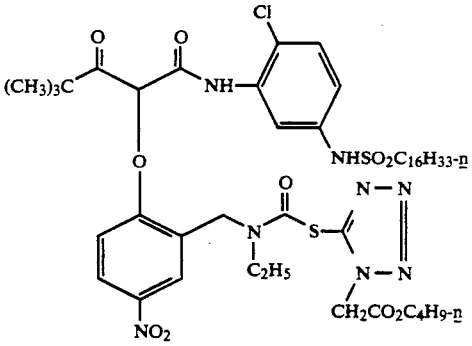
UDIR-1:
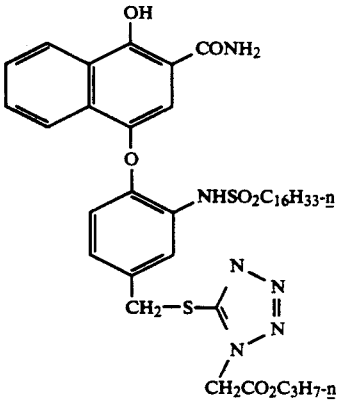
UDIR-2:
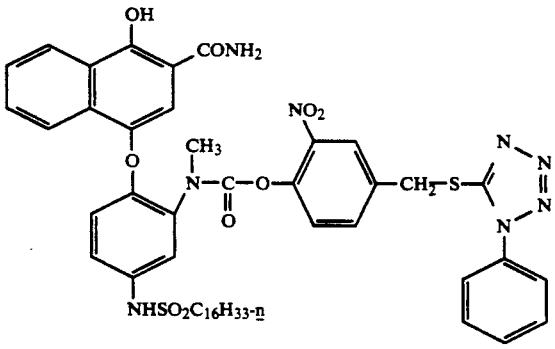
UDIR-3:
UDIR-4

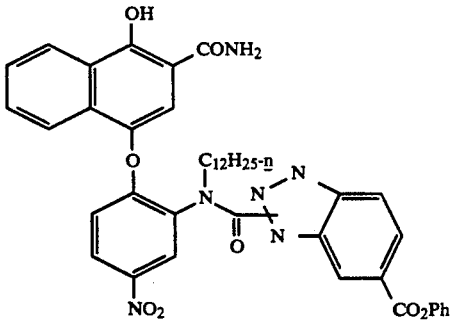

-continued

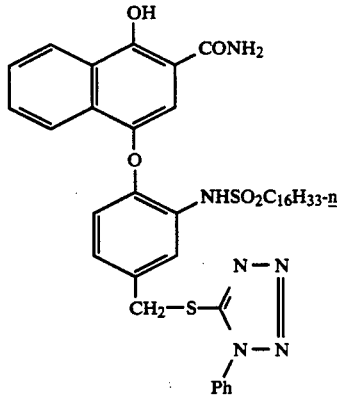

UDIR-5:

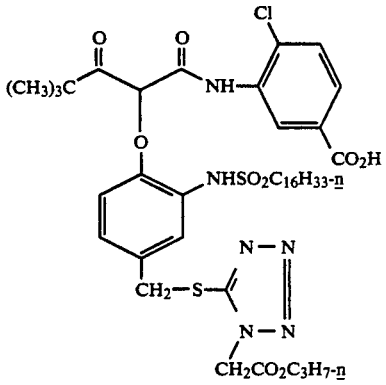

UDIR-6

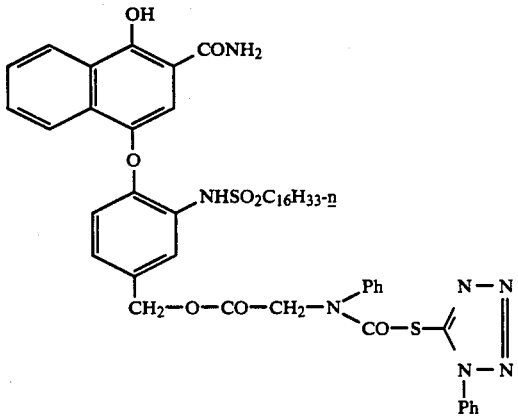

The invention has been described in detail with particular reference to preferred embodiments thereof, but it will be understood that variations and modifications can be effected within the spirit and scope of the invention.

What is claimed is:

1. A color photographic element comprising a support bearing at least one photographic silver halide emulsion layer and a combination of at least two couplers (A) and (B), coupler (A) capable upon reaction with oxidized developer of forming a compound that is washed out of the photographic element during photographic processing and capable of releasing photographic development inhibitor or capable of releasing a timing group having a photographic development inhibitor, the timing group capable of providing timed release of said photographic development inhibitor; and coupler (B), incorporated into the same emulsion layer as coupler (A), and capable upon reaction with oxidized developer of forming a compound that is not washed out of the photographic element during photographic processing and capable of releasing a photographic development inhibitor with or without time delay, coupler (A) represented by the formula:

$$(SOL)_y—COUP—(REL)_n—(TIME)_p—INH$$

and coupler (B) represented by the formula:

$$COUP—(REL)_n—(TIME)_p—INH$$

wherein

SOL is a water solubilizing group;

COUP is a coupler moiety;

TIME is a timing group;

REL is a releasing group;

n and p individually are 0 or 1; and

INH is a releasable development inhibitor group; and y is 1 or 2.

2. A color photographic element as in claim 1 wherein coupler (A) is represented by the formula:

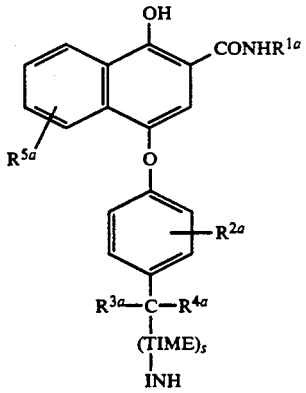

wherein:

$R^{1a}$ is selected from hydrogen, alkyl containing 1-3 carbon atoms, or alkyl or aryl containing at least one solubilizing group;

$R^{2a}$, $R^{3a}$ and $R^{4a}$ are substituents which do not adversely affect the release of INH;

$R^{5a}$ is selected from hydrogen, methyl, —$NO_2$, Cl, —$NHSO_2R$, —$SO_2NHR$, —$OCH_3$, —NHCOR and —CONHR wherein R is substituted or unsubstituted alkyl or aryl, said alkyl or aryl containing 1-10 carbon atoms and which do not adversely affect the release of INH;

at least one of $R^{2a}$, $R^{3a}$ and $R^{4a}$ is a photographic ballast group;

s is 0 or 1; and

INH is a releasable development inhibitor group.

3. A color photographic element as in claim 1 wherein coupler (A) is represented by the formula:

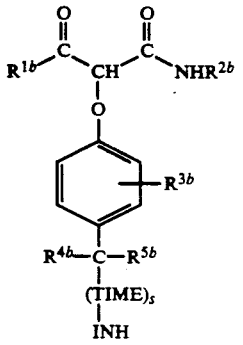

wherein:

$R^{1b}$ and $R_{2b}$ is selected from substituted or unsubstituted alkyl or aryl containing at least one solubilizing group;

$R^{3b}$, $R^{4b}$ and $R^{5b}$ are substituents which do not adversely affect the release of INH;

s is 0 or 1;

at least one of $R^{3b}$, $R^{4b}$ and $R^{5b}$ is a photographic ballast group; and INH is a development inhibitor group.

4. A color photographic element as in claim 1 wherein coupler (B) is represented by the formula:

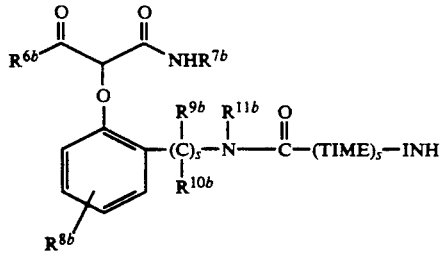

wherein:

$R^{6b}$ and $R^{7b}$ are selected from substituted or unsubstituted alkyl or aryl containing 1-40 carbon atoms;

$R^{8b}$ is selected from hydrogen, methyl, —$NO_2$, Cl, —$NHSO_2R^{15a}$, —$SO_2NHR^{15a}$, —$OCH_3$, —NH-$COR^{15a}$ and —$CONHR^{15a}$ and $R^{15a}$ is selected from substituted or unsubstituted alkyl or aryl containing 1-10 carbon atoms and which do not adversely affect the release of INH;

$R^{9b}$ and $R^{10b}$ is selected from hydrogen, and substituted or unsubstituted alkyl or aryl containing 1-10 carbon atoms;

s is 0 or 1;

INH is a development inhibitor group; and wherein at least one of $R^{6b}$ and $R^{7b}$ comprises a ballast group.

5. A color photographic element as in claim 4 wherein $R^{6b}$ and $R^{7b}$ are substituted with at least one of the groups consisting of —$OCH_3$, —$NO_2$, Cl, —NH-$SO_2R^{12b}$, —$SO_2NHR^{12b}$, —$CONHR^{12b}$, or —NH-$COR^{12b}$ wherein $R^{12b}$ is selected from substituted or unsubstituted alkyl or aryl containing 1-40 carbon atoms.

6. A color photographic element as in claim 1 wherein coupler (B) is represented by the formula:

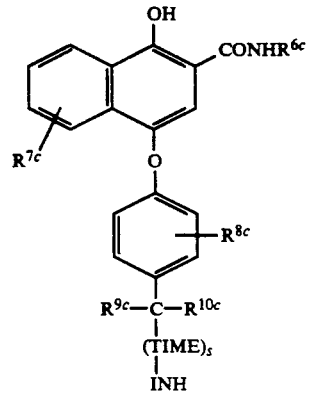

wherein:

$R^{6c}$ is selected from substituted or unsubstituted alkyl or aryl containing 1-40 carbon atoms;

$R^{7c}$ is hydrogen, methyl, —$NO_2$, —$OCH_3$, Cl, —NH-$SO_2R^{11c}$, —$SO_2NHR^{11c}$, —$NHCOR^{11c}$ or —$CONHR^{11c}$ wherein $R^{11c}$ is substituted or unsubstituted alkyl or aryl containing 1-40 carbon atoms;

$R^{8c}$ is selected from hydrogen, methyl, —$NO_2$, Cl, —$NHSO_2R^{15a}$, —$SO_2NHR^{15a}$, —$OCH_3$, —NH-$COR^{15a}$ or —$CONHR^{15a}$ wherein $R^{15a}$ is selected from substituted or unsubstituted alkyl or aryl containing 1-10 carbon atoms and which does not adversely affect the release of INH:

$R^{9c}$ and $R^{10c}$ are selected from substituted or unsubstituted alkyl or aryl containing 1-10 carbon atoms;

s is 0 or 1; and

INH is a releasable development inhibitor group and wherein at least one or $R^{6c}$ and $R^{7c}$ comprise a ballast group.

7. A color phonographic element as in claim 1 wherein coupler (B) is represented by the formula:

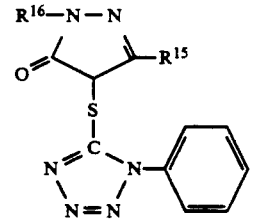

wherein:

$R^{15}$ is an amino or 1-pyrrolidine group and $R^{16}$ is a photographic ballast group.

8. A color photographic element as in claim 1 wherein coupler (A) is represented by at least one of the following formulae:

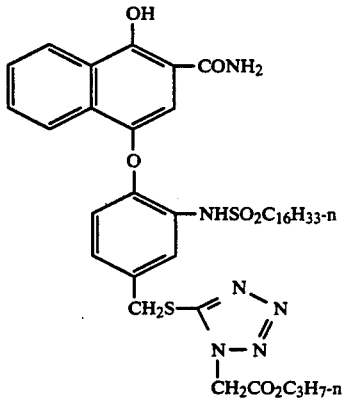

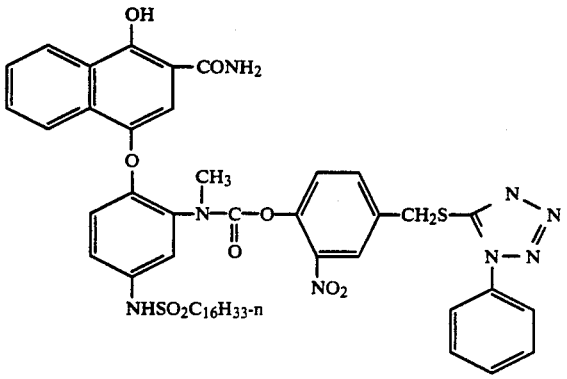

9. A color photographic element as in claim 1 wherein coupler (A) is represented by the formula:

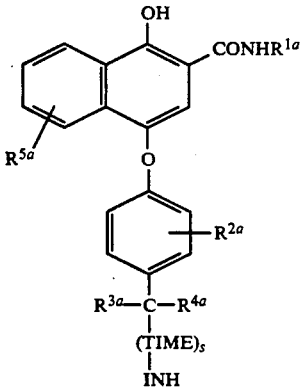

wherein:

$R^{1a}$ is selected from hydrogen, alkyl containing 1-3 carbon atoms, or alkyl or aryl containing at least one solubilizing group;

$R^{2a}$, $R^{3a}$ and $R^{4a}$ are substituents which do not adversely affect the release of INH;

$R^{5a}$ is selected from hydrogen, methyl, $—NO_2Cl$, $—NHSO_2R$, $—SO_2NHR$, $—OCH_3$, —NHCOR and —CONHR wherein R is substituted or unsubstituted alkyl or aryl, said alkyl or aryl containing 1-10 carbon atoms and which do not adversely affect the release of INH;

at least one of $R^{2a}$, $R^{3a}$ and $R^{4a}$ is a photographic ballast group;

s is 0 or 1; and

INH is a releasable development inhibitor group; and coupler (B) is represented by the formula:

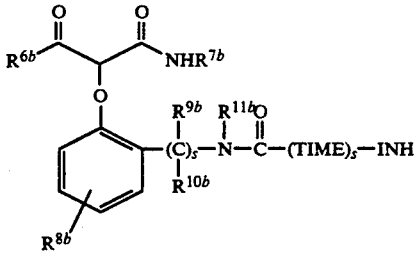

wherein:

$R^{6b}$ and $R^{7b}$ are selected from substituted or unsubstituted alkyl or aryl containing 1-40 carbon atoms;

$R^{8b}$ is selected from hydrogen, methyl, $—NO_2$, Cl, $—NHSO_2R^{15a}$, $—SO_2NHR^{15a}$, $—OCH_3$, $—NHCOR^{15a}$ and $—CONHR^{15a}$ and $R^{15a}$ is selected from substituted or unsubstituted alkyl or aryl containing 1-10 carbon atoms and which doe not adversely affect the release of INH;

$R^{9b}$ and $R^{10b}$ are selected from hydrogen, and substituted or unsubstituted alkyl or aryl containing 1-10 carbon atoms;

$R^{11b}$ is methyl, or substituted alkyl or aryl containing 1-10 carbon atoms;

s is 0 or 1;

INH is a development inhibitor groups; and wherein at least one of $R^{6b}$ and $R^{7b}$ comprises a ballast group.

10. A color photographic element as in claim 1 wherein coupler (A) is represented by the formula:

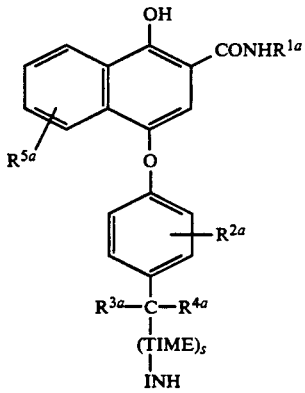

wherein:

$R^{1a}$ is selected from hydrogen, alkyl containing 1-3 carbon atoms, or alkyl or aryl containing at least one solubilizing group;

$R^{2a}$, $R^{3a}$ and $R^{4a}$ are substituents which do not adversely affect the release of INH;

$R^{5a}$ is selected from hydrogen, methyl, $—NO_2Cl$, $—NHSO_2R$, $—SO_2NHR$, $—OCH_3$, —NHCOR and —CONHR wherein R is substituted or unsubstituted alkyl or aryl, said alkyl or aryl containing 1-10 carbon atoms and which do not adversely affect the release of INH;

at least one of $R^{2a}$, $R^{3a}$ and $R^{4a}$ is a photographic ballast group;

s is 0 or 1; and

INH is a releasable development inhibitor group; and coupler (B) is represented by the formula:

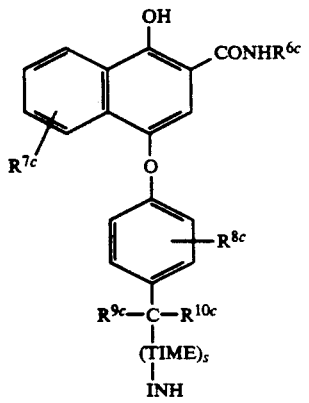

wherein:

$R^{6c}$ is selected from substituted or unsubstituted alkyl or aryl containing 1-40 carbon atoms;

$R^{7c}$ is hydrogen, methyl, $—NO_2$, $—OCH_3$, Cl, $—NHSO_2R^{11c}$, $—CO_2NHR^{11c}$, $—NHCOR^{11c}$ or $—CONHR^{11c}$ wherein $R^{11c}$ is substituted or unsubstituted alkyl or aryl containing 1-40 carbon atoms;

$R^{8c}$ is sleected from hydrogen, methyl, $—NO_2$, Cl, $—NHSO_2R^{15a}$, $—SO_2NHR^{15a}$, $—OCH_3$, $—NHCOR^{15a}$ or $—CONHR^{15a}$ wherein $R^{15a}$ is selected from substituted or unsubstituted alkyl or aryl containing 1-10 carbon atoms and which does not adversely affect the release of INH;

$R^{9c}$ and $R^{10c}$ is selected from substituted or unsubstituted alkyl or aryl containing 1-10 carbon atoms;

s is 0 or 1; and

INH is a releasable development inhibitor group and wherein at least one of $R^{6c}$ and $R^{7c}$ comprise a ballast group.

11. A color photographic element as in claim 1 wherein coupler (A) is represented by the formula:

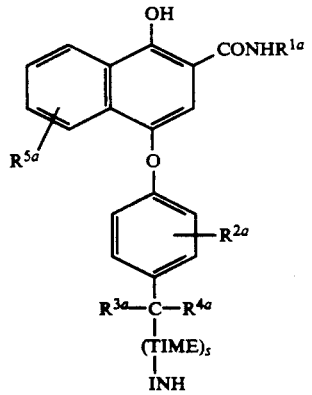

wherein:

$R^{1a}$ is selected from hydrogen, alkyl containing 1-3 carbon atoms, or alkyl or aryl containing at least one solubilizing group;

$R^{2a}$, $R^{3a}$ and $R^{4a}$ are substituents which do not adversely affect the release of INH;

$R^{5a}$ is selected from hydrogen, methyl, $—NO_2$, Cl, $—NHSO_2R$, $—SO_2NHR$, $—OCH_3$, —NHCOR and —CONHR wherein R is substituted or unsubstituted alkyl or aryl, said alkyl or aryl containing 1-10 carbon atoms and which do not adversely affect the release of INH;

at least one of $R^{2a}$, $R^{3a}$ and $R^{4a}$ is a photographic ballast groups;

s is 0 or 1; and

INH is a releasable development inhibitor groups; and coupler (B) is represented by the formula:

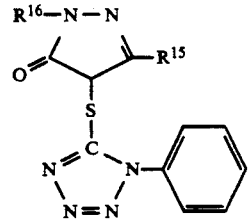

wherein:

$R^{15}$ is an amino or 1-pyrrolidine group; and $R^{16}$ is a photographic ballast group.

12. A color photographic element as in claim 1 wherein coupler (A) is represented by the formula:

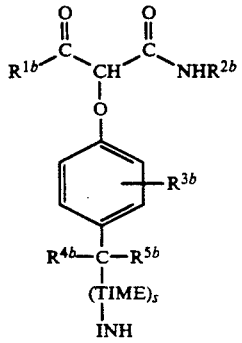

wherein:

$R^{1b}$ and $R^{2b}$ is selected from substituted or unsubstituted alkyl containing at least one solubilizing group;

$R^{3b}$, $R^{4b}$ and $R^{5b}$ are substituents which do not adversely affect the release of INH;

s is 0 or 1;

at least one of $R^{3b}$, $R^{4b}$ and $R^{5b}$ is a photographic ballast group; and INH is a development inhibitor group; and coupler (B) is represented by the formula:

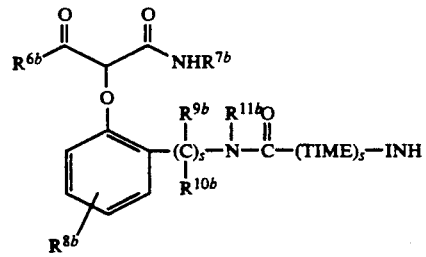

wherein:

$R^{6b}$ and $R^{7b}$ are selected from substituted or unsubstituted alkyl or aryl containing 1-40 carbon atoms;

$R^{8b}$ is selected from hydrogen, methyl, $—NO_2$, Cl, $—NHSO_2R^{15a}$, $—SO_2NHR^{15a}$, $—OCH_3$, $—NHCOR^{15a}$ and $—CONHR^{15a}$ and $R^{15a}$ is selected from substituted or unsubstituted alkyl or aryl containing 1-10 carbon atoms and which do not adversely affect the release of INH;

$R^{9b}$ and $R^{10b}$ is selected from hydrogen, and substituted or unsubstituted alkyl or aryl containing 1-10 carbon atoms;

$R^{1b}$ is methyl, or substituted alkyl or aryl containing 1-10 carbon atoms;

s is 0 or 1;

INH is a development inhibitor group; and wherein at least one of $R^{6b}$ and $R^{7b}$ comprises a ballast group.

13. A color photographic element as in claim 1 wherein coupler (A) is represented by the formula:

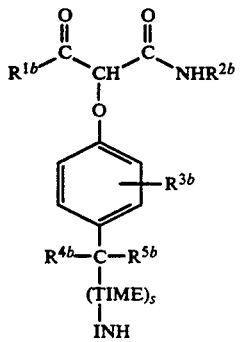

wherein:

$R^{1b}$ and $R^{2b}$ is selected from substituted or unsubstituted alkyl containing at least one solubilizing group;

$R^{3b}$, $R^{4b}$ and $R^{5b}$ are substituents which do not adversely affect the release of INH;

s is 0 or 1;

at least one of $R^{3b}$, $R^{4b}$ and $R^{5b}$ is a photographic ballast group; and INH is a development inhibitor group; and coupler (B) is represented by the formula:

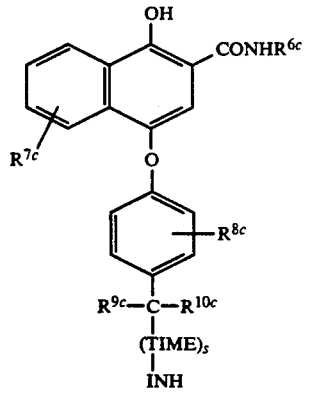

wherein:

$R^{6c}$ is selected from substituted or unsubstituted alkyl or aryl containing 1-40 carbon atoms;

$R^{7c}$ is hydrogen, methyl, $-NO_2$, $-OCH_3$, Cl, $-NHSO_2R^{11c}$, $-SO_2NHR^{11c}$, $-NHCOR^{11c}$ or $-CONHR^{11c}$ wherein $R^{11c}$ is substituted or unsubstituted alkyl or aryl containing 1-40 carbon atoms;

$R^{8c}$ is selected from hydrogen, methyl, $-NO_2$, Cl, $-NSHSO_2R^{15a}$, $-SO_2NHR^{15a}$, $-OCH_3$, $-NHCOR^{15a}$ or $-CONHR^{15a}$ wherein $R^{15a}$ is selected from substituted or unsubstituted alkyl or aryl containing 1-10 carbon atoms and which does not adversely affect the release of INH;

$R^{9c}$ and $R^{10c}$ is selected from substituted or unsubstituted alkyl or aryl containing 1-10 carbon atoms;

s is 0 or 1; and

INH is a releasable development inhibitor group; and wherein at least one of $R^{6c}$ and $R^{7c}$ comprises a ballast group.

14. A color photographic element as in claim 1 wherein coupler (A) is represented by the formula:

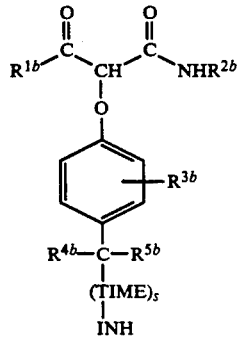

wherein:

$R^{1b}$ and $R^{2b}$ is selected from substituted or unsubstituted alkyl containing at least one solubilizing group;

$R^{3b}$, $R^{4b}$ and $R^{5b}$ are substituents which do not adversely affect the release of INH;

s is 0 or 1;

at least one of $R^{3b}$, $R^{4b}$ and $R^{5b}$ is a photographic ballast group; and INH is a development inhibitor group; and coupler (B) is represented by the formula:

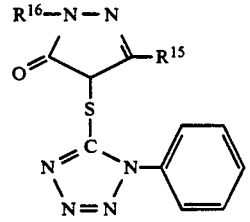

wherein:

$R^{15}$ is an amino or 1-pyrrolidine group; and $R^{16}$ is a photographic ballast group.

15. A color photographic element as in claim 1 wherein coupler (B) is sleected from:

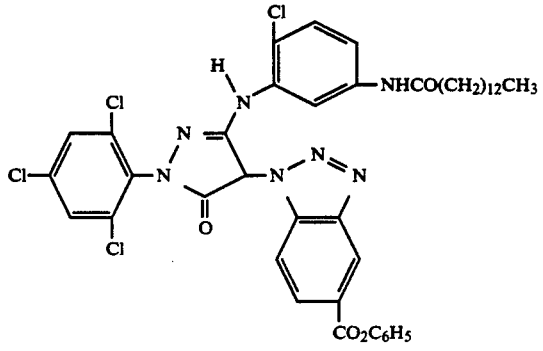

-continued

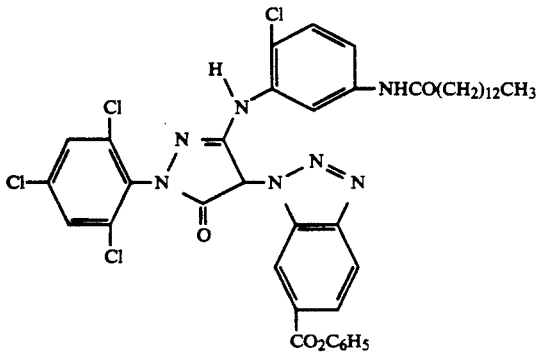

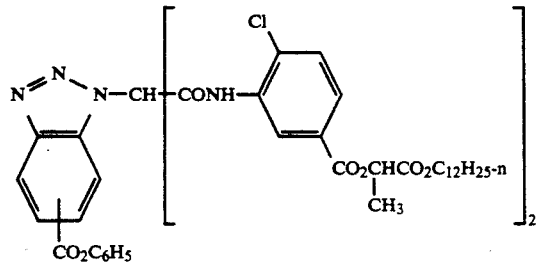

16. A color photographic element as in claim 1 wherein the photographic silver halide emulsion layer comprises an image dye-forming coupler.

17. A color photographic element as in claim 1 wherein the couplers (A) and (B) are naphthol or acylacetamide couplers and the photographic silver halide emulsion layer comprises at least one magenta image dye-forming coupler.

18. A color photographic element as in claim 1 comprising a support bearing at least one red sensitive photographic silver halide emulsion layer comprising at least one cyan image dye-forming coupler;

at least one green sensitive photographic silver halide emulsion layer comprising at least one magenta image dye-forming coupler and a combination of couplers (A) and (B) as defined in claim 1; and at least one blue sensitive photographic silver halide emulsion layer comprising at least one yellow image dye-forming coupler.

19. A color photographic element as in claim 1 wherein the photographic silver halide emulsion comprises an image dye-forming coupler enabling formation of an image dye having a first hue and the coupler (A) and (B) enable formation of a dye having second hue the same or different from the first hue of the dye formed from the image dye-forming coupler.

20. A process of forming a photographic image that comprises developing an exposed photographic silver halide emulsion layer with a color developing agent in the presence of a combination of at least two different couplers as defined in claim 1.

21. A process of forming a photographic image as in claim 17 wherein the couplers (A) and (B) are as defined in claim 7.

* * * * *

UNITED STATES PATENT AND TRADEMARK OFFICE

CERTIFICATE OF CORRECTION

PATENT NO. : 5,286,613

DATED : February 15, 1994

INVENTOR(S) : William J. Begley, et al

It is certified that error appears in the above-indentified patent and that said Letters Patent is hereby corrected as shown below:

Column 33, line 30, "$R_{2b}$" should read --$R^{2b}$--.

Column 33, line 64, before "s is 0 or 1;" insert paragraph reading --$R^{11b}$ is methyl, or substituted alkyl or aryl containing 1-10 carbon atoms;--.

Column 34, line 47, "or" should read --of--.

Column 34, line 49, "phonographic" should read --photographic--.

Column 35, line 59, "-$NO_2Cl$," should read ---$NO_2$, Cl,--.

Column 36, line 58, "-$NO_2Cl$," should read ---$NO_2$, Cl,--.

UNITED STATES PATENT AND TRADEMARK OFFICE

CERTIFICATE OF CORRECTION

PATENT NO. : 5,286,613

DATED : February 15, 1994

INVENTOR(S) : William J. Begley, et al

It is certified that error appears in the above-indentified patent and that said Letters Patent is hereby corrected as shown below:

Column 38, line 4, "groups;" should read --group;--.

Column 39, line 6, "$R^{1b}$" should read --$R^{11b}$--.

Column 39, line 66, "-$NSHSO_2R^{15a}$," should read --$NHSO_2R^{15a}$,--.

Column 40, line 52, "sleected" should read --selected--.

Signed and Sealed this

Sixteenth Day of August, 1994

Bruce Lehman

*Attest:*

BRUCE LEHMAN

*Attesting Officer*

*Commissioner of Patents and Trademarks*